US007913355B2

(12) United States Patent
Choi

(10) Patent No.: US 7,913,355 B2
(45) Date of Patent: Mar. 29, 2011

(54) BIDIRECTIONAL OPENING/CLOSING DOOR UNIT AND REFRIGERATOR HAVING THE SAME

(75) Inventor: Young Keun Choi, Cheonan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 546 days.

(21) Appl. No.: 12/007,473

(22) Filed: Jan. 10, 2008

(65) Prior Publication Data

US 2008/0172838 A1 Jul. 24, 2008

(30) Foreign Application Priority Data

Jan. 23, 2007 (KR) ..... 10-2007-0007145

(51) Int. Cl.
*E05D 15/50* (2006.01)

(52) U.S. Cl. ..... 16/230; 16/232

(58) Field of Classification Search ..... 16/230, 16/231, 232, DIG. 23; 49/193, 382, 397, 49/399; 312/324, 328, 329, 405
See application file for complete search history.

(56) References Cited

U.S. PATENT DOCUMENTS

| | | | | | |
|---|---|---|---|---|---|
| 3,889,419 | A | * | 6/1975 | Maleck | 49/193 |
| 4,495,673 | A | * | 1/1985 | Khan | 16/232 |
| 4,503,582 | A | * | 3/1985 | Gurubatham | 16/232 |
| 4,947,583 | A | * | 8/1990 | Inui et al. | 49/193 |
| 5,187,836 | A | * | 2/1993 | Kim et al. | 16/231 |
| 5,548,927 | A | * | 8/1996 | Song | 49/193 |
| 5,675,934 | A | * | 10/1997 | Park | 49/193 |
| 5,829,197 | A | * | 11/1998 | Oh | 49/193 |

FOREIGN PATENT DOCUMENTS

| | | | |
|---|---|---|---|
| CN | 2082382 | | 8/1991 |
| CN | 2202782 | | 7/1995 |
| JP | 07174456 | A * | 7/1995 |
| KR | 10-2004-00067205 | | 7/2004 |

OTHER PUBLICATIONS

Chinese Office Action issued in corresponding Chinese Application No. 200810004064.3; mailed Aug. 7, 2009.

* cited by examiner

*Primary Examiner* — Chuck Y. Mah
(74) *Attorney, Agent, or Firm* — Staas & Halsey LLP

(57) ABSTRACT

A bidirectional opening/closing door unit and a refrigerator having the same. The door unit is provided at a side of a body of the refrigerator to open or close the body. The body includes hinges protruding from left and right sides of the body to be coupled with the door unit. The door unit includes a door and an opening/closing device provided at a side of the door. The opening/closing device includes a pair of opening/closing structures detachable to the respective hinges, and an operative connector to be operatively connected to one of the opening/closing structures to limit operation of the other opening/closing structure. With this configuration, the operative connector can achieve smooth movements and maintain a high durability in spite of frequency opening/closing operations and long time use of the door.

19 Claims, 7 Drawing Sheets

BIDIRECTIONAL OPENING/CLOSING DOOR UNIT AND REFRIGERATOR HAVING THE SAME

CROSS-REFERENCE TO RELATED APPLICATIONS

This application claims the benefit of Korean Patent Application No. 2007-0007145, filed on Jan. 23, 2007 in the Korean Intellectual Property Office, the disclosure of which is incorporated herein by reference.

BACKGROUND

1. Field

The present invention relates to a door unit, and more particularly, to a door unit which is applicable to a refrigerator and has a bidirectional opening/closing structure, and a refrigerator having the same.

2. Description of the Related Art

A refrigerator is an apparatus to supply cold air, produced by a refrigeration cycle, into a storage compartment to maintain freshness of a variety of foods for a long time. Generally, the refrigerator includes a body having the storage compartment to store foods therein, and a door pivotally rotatably installed to the body by a hinge device to open or close the storage compartment.

The door included in the refrigerator has been fabricated to open or close the storage compartment only in a predetermined direction, for example, only in a rightward opening/closing manner or leftward opening/closing manner. Here, the term "rightward opening/closing manner" means that the hinge device is coupled to a right end of the door such that the door is pivotally rotated about the right end thereof, and the term "leftward opening/closing manner" means that the hinge device is coupled to a left end of the door such that the door is pivotally rotated about the left end thereof.

Accordingly, since the door is allowed to be opened or closed only in a predetermined direction once the refrigerator is installed at a certain place, the door may have a difficulty in opening and closing operations if any restrictive items, such as home electronics, etc., exist in the opening/closing direction of the door. Therefore, it is necessary to change the installation position of the refrigerator. Further, the one-directional opening/closing door is unsuitable to be conveniently used by a right-handed person and a left-handed person together, and consequently, causes dissatisfaction of customers.

To solve the above described problems, recently, a reversible door capable of allowing a user to selectively change an opening/closing direction of the door in consideration of his/her use convenience has been developed.

One example of the reversible door is disclosed in Korean Patent Laid-open Publication No. 10-2004-0067205.

The reversible door, disclosed in the above Publication, is a detachable bidirectional opening/closing door wherein, to allow the door to be opened or closed in a desired direction, first and second bracket assemblies coupled to opposite sides of the door are first disassembled, and after the door is located in a desired direction, respective constituent elements of the first and second bracket assemblies are assembled again.

However, when changing the opening/closing direction of the door according to the user's intention, it requires a complicated procedure to disassemble the bracket assemblies and again assemble them in an opposite direction.

SUMMARY

The present embodiment has been made in order to solve the above problems. It is an aspect of the embodiment to provide a door unit capable of being opened or closed in dual directions without any door disassembling and reassembling operations.

It is a further aspect of the embodiment to provide a bidirectional opening/closing door unit configured to achieve a high durability thereof.

Additional aspects and/or advantages of the invention will be set forth in part in the description which follows and, in part, will be obvious from the description, or may be learned by practice of the invention.

In accordance with the invention, the above and/or other aspects can be achieved by the provision of an apparatus, including: a body including hinges protruding from opposing sides of the body; a door unit including a door and an opening/closing device provided at a side of the door, the door unit being provided at a side of the body to open or close the body, wherein the hinges are able to be coupled with the door unit, and wherein the opening/closing device includes a pair of opening/closing structures detachable from the respective hinges and having an eccentric portion, and an operative connector to be pressured by the eccentric portion of one of the opening/closing structures to limit operation of the other of the opening/closing structures.

The operative connector may be spaced apart from the pair of opening/closing structures by a predetermined distance and may be disposed between the pair of opening/closing structures.

Each of the opening/closing structures may include a rotatable latch having a receiving recess to engage the respective hinge and a pressure member to pressure the latch to keep the latch at a rotated position.

The latch may include an over-rotation preventing portion defined therein to prevent over-rotation thereof.

The operative connector may include elastic elements, and the operative connector may be elastically returned when a pressure force applied to the operative connector by one of the opening/closing structures is removed.

The opening/closing device may further include a fixing plate fixing the opening/closing structures and the operative connector.

The fixing plate may include at least one guide protrusion to guide movement of the operative connector, and the operative connector includes at least one guide slot corresponding to the at least one guide protrusion.

The latch may be provided between the pressure member and the operative connector.

The fixing plate may include hinge holes defined therein and providing for detachable insertion of the respective hinges.

The opening/closing device may be provided at an upper end of the door.

The opening/closing device may be provided at a lower end of the door.

The foregoing and/or other aspects are achieved by providing a refrigerator including a body in which items are cooled and a door unit provided to open or close the body thereof, the refrigerator including: hinges protruding from left and right sides of the body; a fixing plate having hinge holes defined therein and providing for insertion of the respective hinges; a pair of opening/closing structures provided at opposite sides of the fixing plate to detachably couple the hinges; and an operative connector spaced apart from the pair of opening/closing structures by a predetermined distance, the operative connector being movable by a pressure force applied by one of the pair of opening/closing structures such that movement of the other of the opening/closing structures is limited by movement of the operative connector.

The operative connector may include elastic elements, and the operative connector is returned when a pressure force applied to the operative connector by one of the opening/closing structures is removed.

The foregoing and/or other aspects are achieved by providing a refrigerator, including: a body storing items to be cooled; a door attached to the body to open or close the body; and at least one opening/closing device disposed at a top or a bottom of the door, the opening/closing device allowing the door to be selectively opened in a leftward or rightward direction, the at least one opening/closing device including a pair of latches and an operative connector disposed between the pair of latches, one of the pair of latches contacting the operative connector to pressure the operative connector when the door is selectively opened in a leftward or rightward direction.

The door may include a pair of hinges and the opening/closing device may include a pair of hinge holes at opposing ends thereof, each one of the hinges being receivable into one of the hinge holes.

Each of the latches may include a recess, each of the hinges may be held within one of the hinge holes and the recess when the door is closed and one of the hinges may be released from one of the hinge holes and the recess when the door is selectively opened in a leftward or rightward direction.

The at least one opening/closing device may include a pressure member to pressure each of the latches to keep each of the latches at a rotated position.

Each of the latches may include an eccentric portion pressurizing the operative connector when the door is selectively opened in the leftward or the rightward direction.

The operative connector may include at least one elastic element causing the operative connector to elastically return when a pressure force applied to the operative connector by the eccentric portion is removed.

Each of the latches may include an over-rotation preventing portion defined therein to prevent an over-rotation of each of the latches.

The foregoing and/or other aspects are achieved by providing an apparatus, including: a body storing items; a door attached to the body to open or close the body; and at least one opening/closing device disposed at a top or a bottom of the door, the opening/closing device allowing the door to be selectively opened in a leftward or rightward direction, the at least one opening/closing device including a pair of latches and an operative connector disposed between the pair of latches, one of the pair of latches contacting the operative connector to pressure the operative connector when the door is selectively opened in a leftward or rightward direction.

BRIEF DESCRIPTION OF THE DRAWINGS

These and/or other aspects and advantages will become apparent and more readily appreciated from the following description of the embodiment, taken in conjunction with the accompanying drawings, of which.

DETAILED DESCRIPTION OF THE EMBODIMENT

Figure 1:
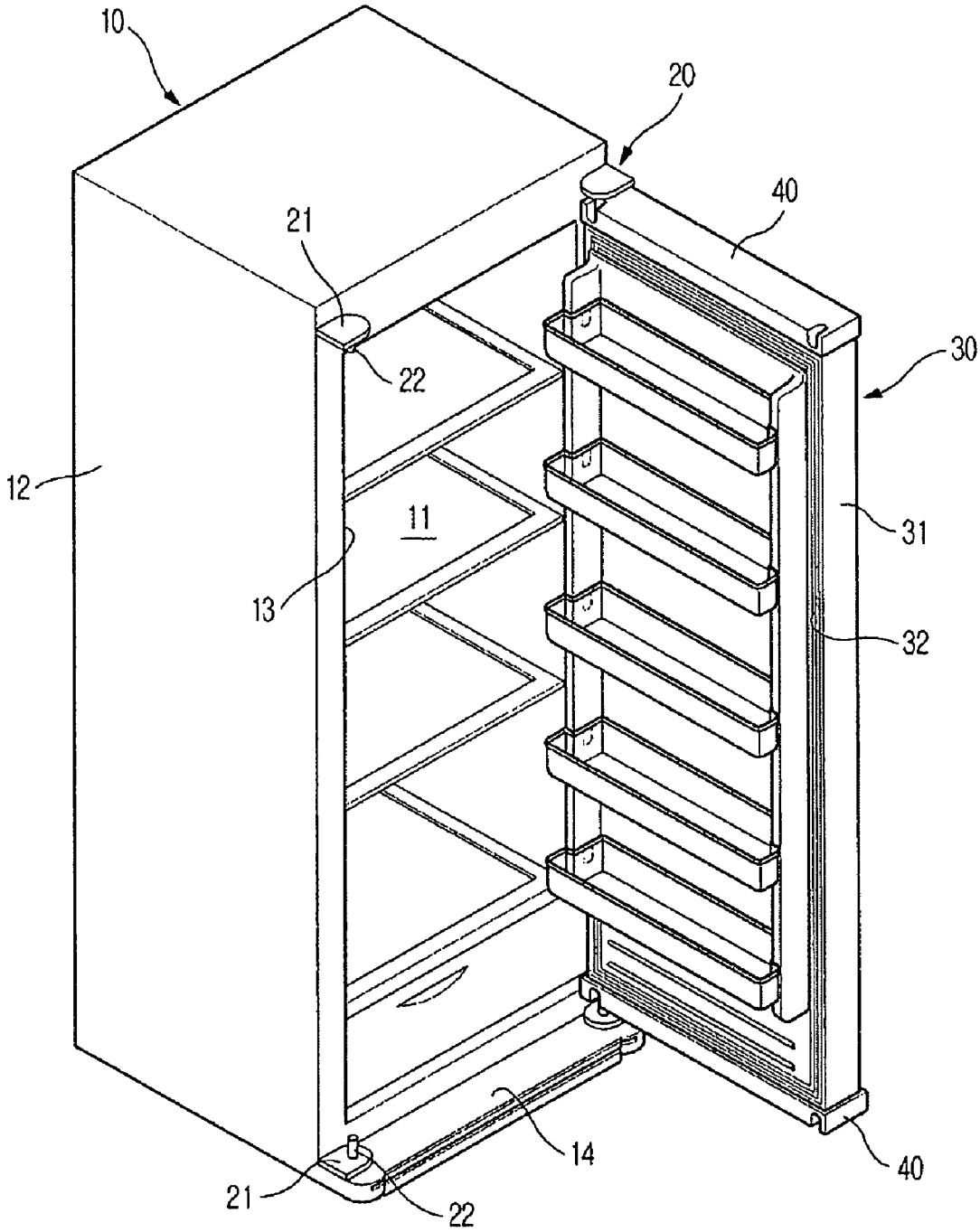
FIG. 1 is a perspective view illustrating an outer appearance of a refrigerator in accordance with the present embodiment.

Reference will now be made in detail to embodiments, examples of which are illustrated in the accompanying drawings, wherein like reference numerals refer to like elements throughout. The embodiments are described below to explain the present invention by referring to the figures.

Figure 2:
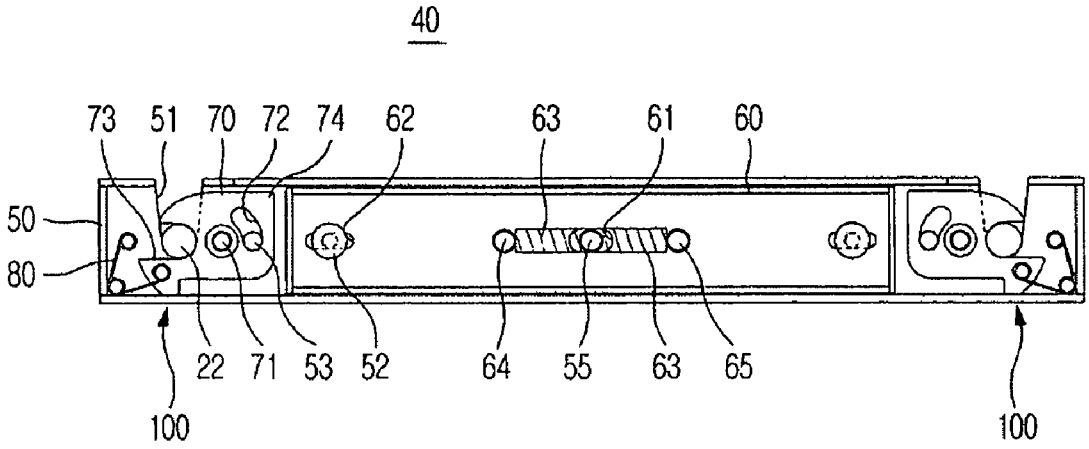
FIG. 2 is a sectional view illustrating an opening/closing device for a door unit included in the refrigerator in accordance with the present embodiment.
Figure 3:
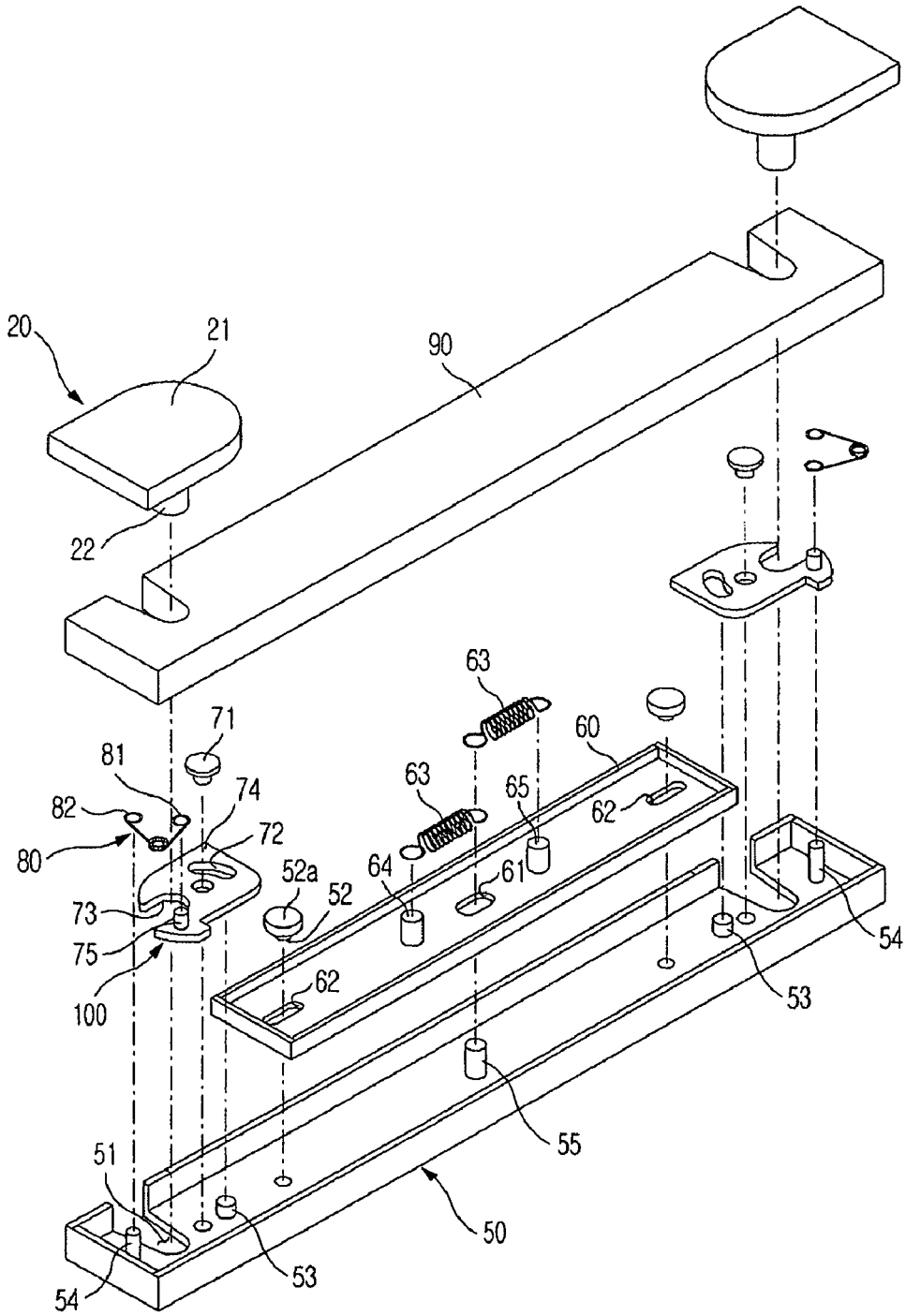
FIG. 3 is an exploded perspective view of the opening/closing device of FIG. 2.
Figure 4A:
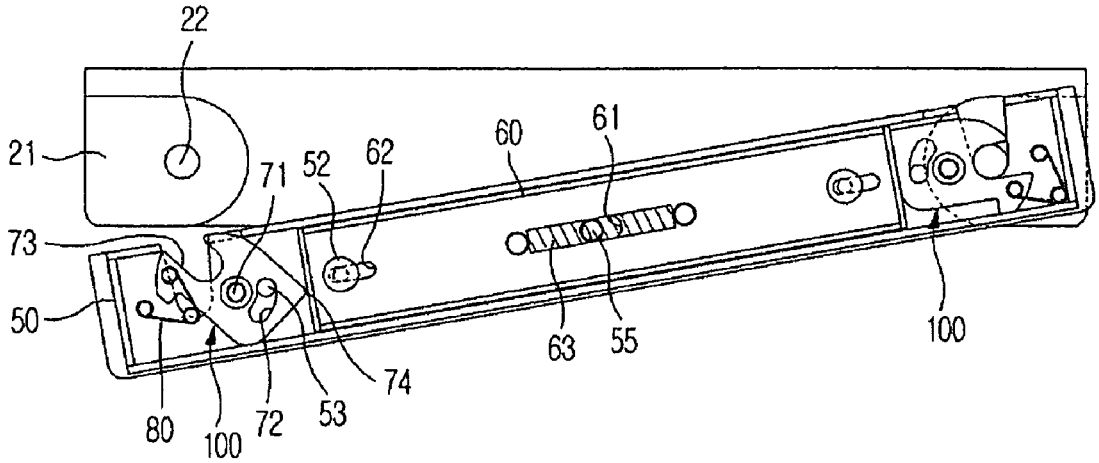
FIGS. 4A and 4B are sectional views illustrating a rightward opening/closing operation of the door unit included in the refrigerator in accordance with the present embodiment.
Figure 4B:
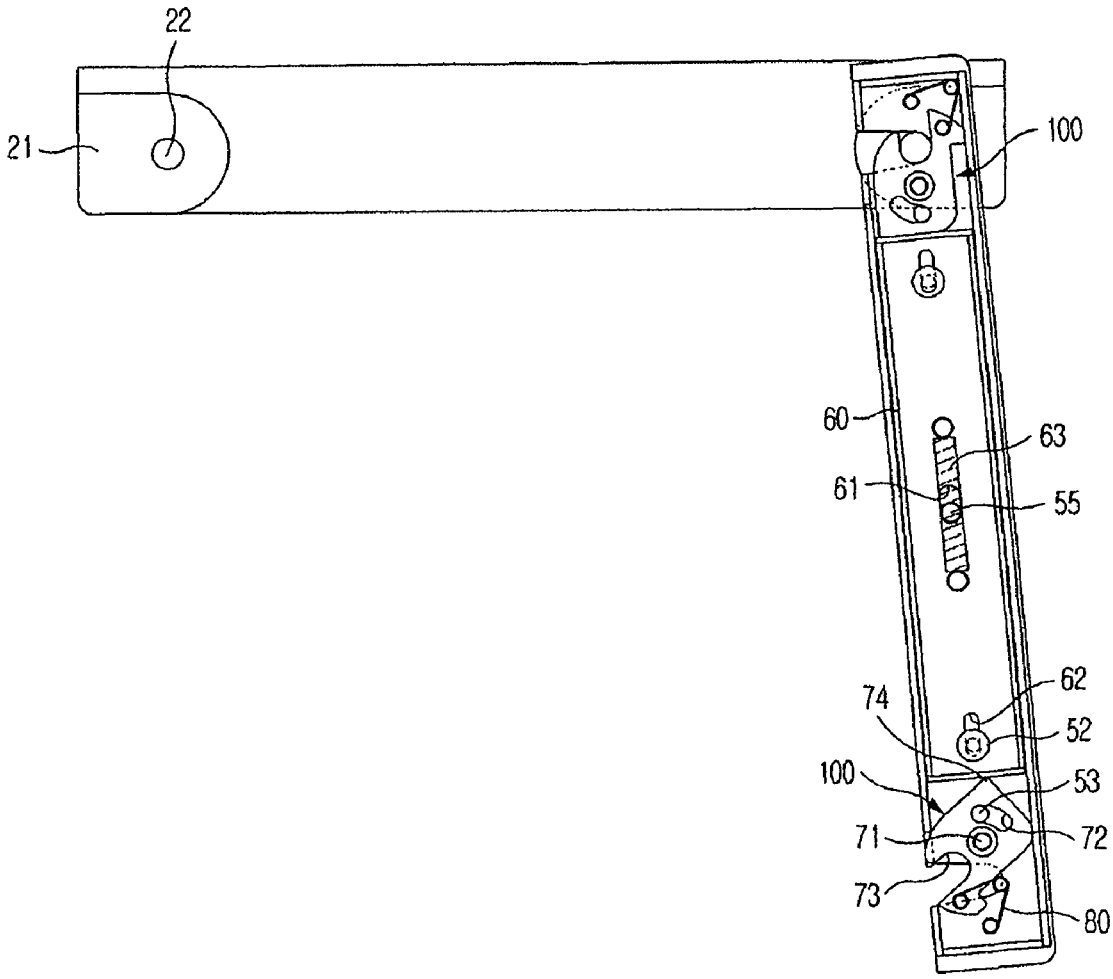
Figure 5A:
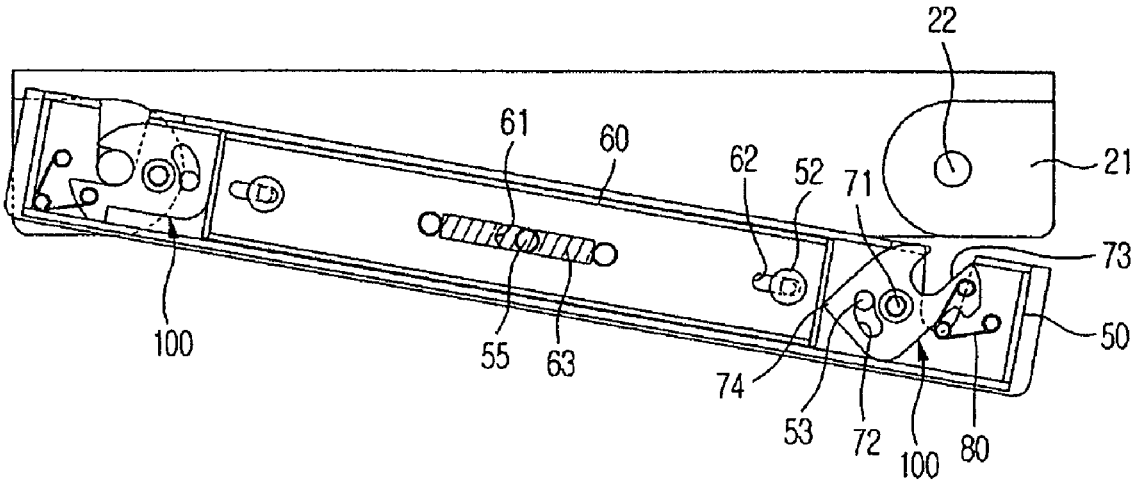
FIGS. 5A and 5B are sectional views illustrating a leftward opening/closing operation of the door unit included in the refrigerator in accordance with the present embodiment.
Figure 5B:
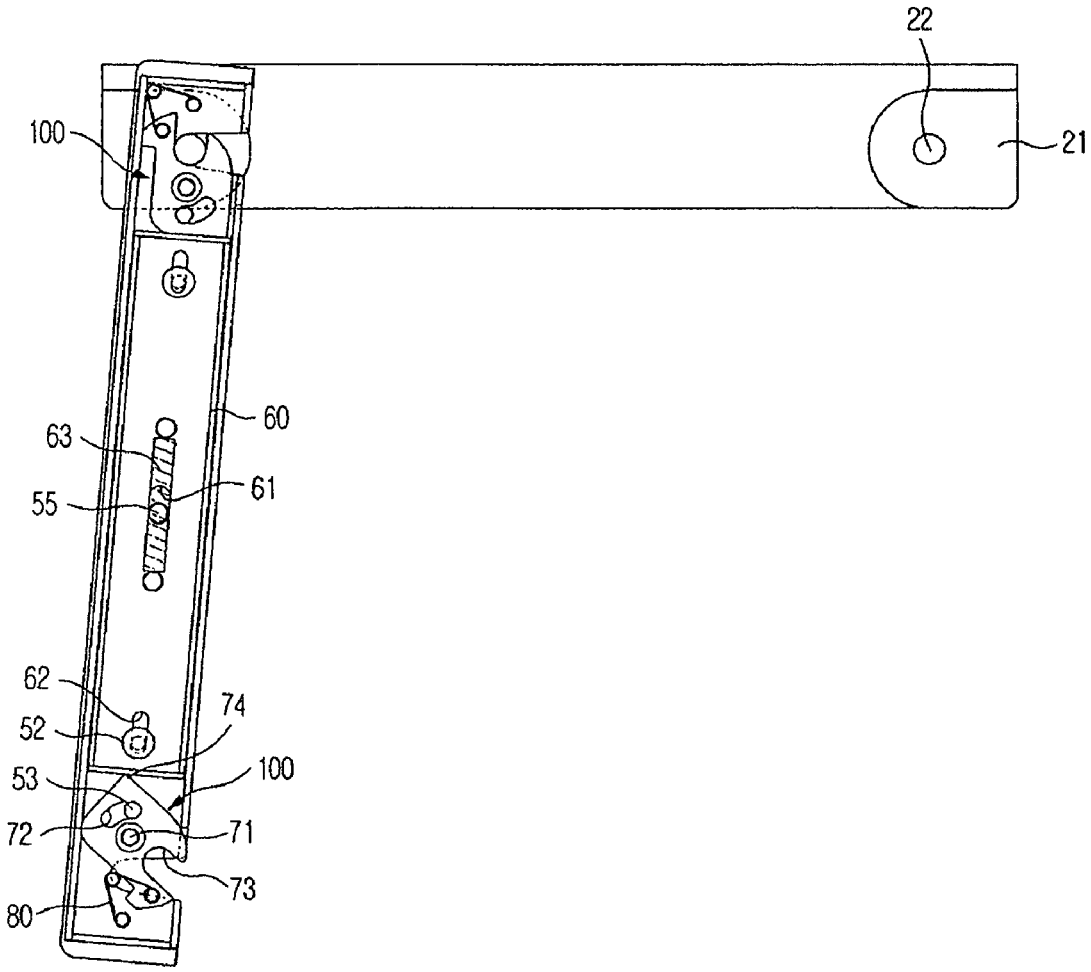

FIG. 1 is a perspective view illustrating an outer appearance of a refrigerator in accordance with the present embodiment. FIG. 2 is a sectional view illustrating an opening/closing device for a door unit included in the refrigerator in accordance with the present embodiment, and FIG. 3 is an exploded perspective view of the opening/closing device of FIG. 2. FIGS. 4A and 4B are sectional views illustrating a rightward opening/closing operation of the door unit included in the refrigerator in accordance with the present embodiment, and FIGS. 5A and 5B are sectional views illustrating a leftward opening/closing operation of the door unit included in the refrigerator in accordance with the present embodiment.

The refrigerator in accordance with the present embodiment, as shown in FIG. 1, includes a body 10 having a storage compartment 11 to store foods therein, and a bidirectional opening/closing door unit 30 provided at a front surface of the body 10 to open or close the storage compartment 11 in dual directions.

Although not shown in the drawings, it can be understood by those skilled in the art that the refrigerator employs a refrigeration cycle including a compressor, evaporator, condenser, etc.

The body 10 includes an outer shell 12 forming an outer surface of the body 10 and an inner shell 13 disposed inside the outer shell 12 with a predetermined gap and defining the storage compartment 11 therein. A heat-insulating material is foamed in a space between the outer shell 12 and the inner shell 13, to prevent leakage of cold air.

A pair of hinge members 20 symmetrically protrudes forward from upper left and right sides of a front surface of the body 10. Each of the hinge members 20 includes a supporting plate 21 extending orthogonally to the front surface of the body 10 and a hinge 22 vertically protruding downward from the supporting plate 21.

Additional hinge members 20 are also symmetrically provided at a lower end of the body 10. In conclusion, the hinge members 20 are provided at upper and lower left and right sides of the front surface of the body 10.

A supporting board 14 protrudes forward from the lower end of the body 10, to support the weight of a door. The supporting plates 21 of the hinge members 20, provided at a lower end of the body 10, are disposed on the supporting board 14. Also, the hinges 22 of the hinge members 20 are separably inserted into hinge holes 51 of a fixing plate 50 that will be described hereinafter.

The door unit 30 includes a door 31 and a pair of opening/closing devices 40 provided at upper and lower ends of the door 31 and adapted to open or close the door 31 via engagement and disengagement with the hinges 22.

The door 31 has an approximately rectangular shape, for example, and is located at the front surface of the body 10. A gasket 32 is provided to surround an inner rim of the door 31, to prevent leakage of cold air from the storage compartment 11. A pair of grips (not shown) is provided at left and right sides of a front surface of the door 31, to facilitate bidirectional opening/closing operations of the door 31.

The opening/closing device 40 provided at the upper end of the door 31, as shown in FIGS. 2 and 3, includes the fixing plate 50 fixed to upper ends of side surfaces of the door 31, a pair of opening/closing structures 100 provided at left and right sides of the fixing plate 50 to enable the engagement and disengagement of the hinges 22, and an operative connector 60 provided between the pair of opening/closing structures 100 and adapted to move transversely in association with the operation of the opening/closing structures 100.

The fixing plate 50 has the hinge holes 51 formed in opposite side positions thereof corresponding to the hinges 22, to allow the hinges 22 to be detachably inserted thereinto. The fixing plate 50 further has guide protrusions 52 and 55, to guide smooth movements of the operative connector 60.

The pair of opening/closing structures 100 is provided in the fixing plate 50 at positions adjacent to the respective hinge holes 51. The pair of opening/closing structures 100 has the same configuration as each other and is symmetrically arranged at left and right positions. Therefore, the following description deals with only one left opening/closing structure 100 located at the left side of the drawing, and a description related to the right opening/closing structure 100 will be omitted and replaced by the following description of the left opening/closing structure 100.

The opening/closing structure 100 includes a latch 70 rotatably mounted on the fixing plate 50, and a pressure member 80 provided between an outer end of the latch 70 and the end of the fixing plate 50.

The latch 70 is rotatably mounted on the fixing plate 50 by a rotating shaft 71. An arched over-rotation preventing portion 72 is formed at a side of the rotating shaft 71 to limit a rotation angle of the latch 70. To correspond to the over-rotation preventing portion 72, a protrusion 53 is provided on the fixing plate 50 at a fixed position.

The latch 70 is formed, at an opposite position of the over-rotation preventing portion 72 about the rotating shaft 71, with a receiving recess 73 to be engaged with or disengaged from the hinge 22 according to rotations of the latch 70. The latch 70 is further formed, at an outer side of the over-rotation preventing portion 72, with an eccentric portion 74 to pressure the operative connector 60 or to be spaced apart from the operative connector 60 according to rotations of the latch 70. When the door 31 is opened, the latch 70 located in the opening side of the door 31 is rotated such that the eccentric portion 74 pressures the operative connector 60. The pressurized operative connector 60 is moved transversely to come into contact with a surface of the other latch 70. Accordingly, the operative connector 60 limits rotations of the other latch 70 such that the hinge 22 is surrounded by the receiving recess 73 of the latch 70. Thereby, the latch 70 can prevent the hinge 22 from being separated from the hinge hole 51 and allow the door 31 to pivotally rotate about the hinge 22, resulting in opening and closing operations of the door body 31.

The pressure member 80 has one end fixed to a pressure member mount 75 of the latch 70, and the other end fixed to a pressure member mount 54 of the fixing plate 50. With this configuration, the pressure member 80 can produce an elastic force required to maintain restriction and release positions of the hinge 22 by the latch 70, that is to say, positions of the latch 70 upon opening and closing of the door 31.

The operative connector 60 is provided between the pair of opening/closing structures 100. The operative connector 60 has a plurality of guide slots 61 and 62 arranged to correspond to the guide protrusions 52 and 55 to guide smooth transversal movements of the guide protrusions 52 and 55. The plurality of guide slots 61 and 62 include a center first guide slot 61 and a pair of second guide slots 62 provided at opposite sides of the first guide slot 61 to correspond to each other.

With the above described configuration, the center guide protrusion 55 penetrates through the first guide slot 61, and both the side guide protrusions 52 penetrate through the respective second guide slots 62. In this way, the operative connector 60 can be guided by the guide protrusions 52 and 55 for smooth movements thereof.

In this case, a head portion 52*a* of each guide protrusions 52 has a diameter larger than a width of the guide slot 62, and can prevent the operative connector 60 from coming off vertically from the fixing plate 50 during movements of the operative connector 60.

The operative connector 60 includes a pair of elastic elements 63, which are arranged at left and right sides of the center guide protrusion 55.

Any one of the elastic elements 63 has one end secured to a first fixture 64 of the operative connector 60 and the other end secured to the center guide protrusion 55. The other elastic element 63 has one end secured to the second fixture 65 of the operative connector 60 and the other end secured to the center guide protrusion 55.

In operation of the operative connector 60 having the above-described elastic elements 63, when the door is opened in a rightward opening/closing manner, the left latch 70 is rotated, and the operative connector 60 is moved rightward by the pressure force applied by the eccentric portion 74, to come into contact with the right latch 70. In this case, the elastic element 63 between the first fixture 64 and the center guide protrusion 55 is contracted, and the elastic element 63 between the second fixture 65 and the center guide protrusion 55 is extended. Thereafter, when the door is closed, if the left latch 70 is rotated in an opposite direction and the pressure force applied by the eccentric portion 74 is removed, the operative connector 60 is returned to its original position by the elastic restoration force of the elastic element 63, to be spaced apart from both the latches 70.

The operative connector 60 is disposed in the fixing plate 50 and has approximately the same width as that of the fixing plate 50. Accordingly, the operative connector 60 has only a minimized movement in a longitudinal direction of the fixing plate 50 and can be moved only in a transversal direction of the fixing plate 50.

To achieve an improved superior outer appearance, a cover 90 is provided at an upper end of the fixing plate 50, in which the opening/closing structures 100 and the operative connector 60 are received therein, to prevent the internal elements from being exposed to the outside.

As stated above, the operative connector 60 has a large width equal to that of the fixing plate 50 and can achieve smooth movements thereof by virtue of the elastic elements 63 received therein. Also, since the head portion 52*a* of each guide protrusion 52 has a diameter larger than the width of the guide slot 62, the operative connector 60 has no risk of coming off vertically from the fixing plate 50 during movements thereof. Accordingly, the operative connector 60 can achieve a high durability in spite of frequent opening and closing operations and long time use of the door 31.

Also, by arranging the operative connector 60 and the pressure member 80 at opposite sides of the latch 70, the height of the opening/closing device 40 can be reduced.

Hereinafter, the operation of the door unit included in the refrigerator in accordance with the present embodiment will be described.

In a closed state of the door, the hinge 22 is inserted in the hinge hole 51 of the fixing plate 50 while being restricted by the receiving recess 73 of the latch 70 to maintain the door in the closed state.

In this case, when the door is opened in a rightward opening/closing direction, as shown in FIGS. 4A and 4B, the latch 70 of the left opening/closing structure 100 is rotated clockwise by the door opening force. With the rotation of the latch 70, the opening side of the receiving recess 73 of the latch 70 is aligned with the opening side of the hinge hole 51, thereby causing the hinge 22 to be separated from the opening/closing device 40.

In this case, the eccentric portion 74 pressures the left surface of the operative connector 60 with the rotation of the latch 70. Thereby, the operative connector 60 is moved rightward, to come into contact with the right opening/closing structure 100. After the rotation of the latch 70 is performed to some extent, one end of the over-rotation preventing portion 72 is caught by the protrusion 53 of the fixing plate 50, to prevent over-rotation of the left latch 70. Furthermore, the moved operative connector 60 limits rotation of the right latch 70. As a result, the door is pivotally rotated about the right hinge 22 as a rotating shaft, to thereby be opened.

Also, when the door is closed, the hinge 22 pushes one side of the receiving recess 73 of the latch 70, thus causing the latch 70 to rotate counterclockwise. Accordingly, the hinge 22 is inserted into the receiving recess 73 of the latch 70 and the hinge hole 51 of the fixing plate 50 without the risk of separation. Simultaneously, the pressure force applied to the operative connector 60 by the eccentric portion 74 is removed. Thereby, the operative connector 60 can be returned to its original position spaced apart from both the opening/closing structures 100 by a predetermined distance, under the influence of the elastic restoration force of the elastic elements 63 provided at the operative connector 60.

Similarly, when the door is opened in a leftward opening/closing direction, as shown in FIGS. 5A and 5B, the left opening/closing structure 100 performs the same operation as the rightward opening/closing operation of the right opening/closing structure 100, and the right opening/closing structure 100 performs the same operation as the leftward opening/closing operation of the left opening/closing structure 100, resulting in opening and closing operations of the door.

Although the above embodiment describes the opening/closing device 40 of the door provided at an upper end of the door, it will be appreciated that the same opening/closing device 40 can be provided at a lower end of the door, to perform the same operation as the above description.

Also, it will be appreciated that, although the refrigerator is exemplified as a product having the door unit in accordance with the present embodiment, the bidirectional opening/closing door unit of the present embodiment is also applicable to other articles except for the refrigerator.

As apparent from the above description, in the present embodiment, a pair of door opening/closing devices is provided at upper and lower ends of a door to open or close the door in dual directions. Accordingly, the present embodiment has the effect of opening or closing the door in dual directions without disassembling and re-assembling of the door.

Further, according to the present embodiment, an operative connector, which has a width corresponding to that of a fixing plate, is movably disposed on the fixing plate while being spaced apart from latches. With this configuration, the operative connector can achieve smooth movements and maintain a high durability in spite of frequent opening/closing operations and long time use of the door.

Furthermore, by arranging the operative connector and a pressure member at opposite sides of each latch, the height of the opening/closing device can be reduced, resulting in a compact configuration of the opening/closing device.

Although an embodiment has been shown and described, it would be appreciated by those skilled in the art that changes may be made in this embodiment without departing from the principles and spirit of the invention, the scope of which is defined in the claims and their equivalents.

What is claimed is:

1. An apparatus, comprising:

a body including hinges protruding from opposing sides of the body;

a door unit including a door and an opening/closing device provided at a side of the door, the door unit being provided at a side of the body to open or close the body, wherein the hinges are able to be coupled with the door unit, and wherein the opening/closing device includes a pair of opening/closing structures each having an eccentric portion, and an operative connector disposed between the pair of opening/closing structures, each of the opening/closing structures receiving and holding one of the hinges and being spaced apart from the operative connector in a first position of the opening/closing device and at least one of the opening/closing structures being detachable from the respective hinge and releasing the hinge in a second position of the opening/closing device, the eccentric portion of one of the opening/closing structures abutting against and pressing the operative connector in one direction when the opening/closing device is moved from the first position to the second position to prevent movement of the other of the opening/closing structures.

2. The door unit according to claim 1, wherein each of the opening/closing structures comprises a rotatable latch having a receiving recess to engage the respective hinge and a pressure member to pressure the latch to keep the latch at a rotated position.

3. The door unit according to claim 2, wherein the latch includes an over-rotation preventing portion defined therein to prevent over-rotation thereof.

4. The door unit according to claim 1, wherein the operative connector includes elastic elements, and wherein the operative connector is elastically returned when a pressure force applied to the operative connector by one of the opening/closing structures is removed.

5. The door unit according to claim 1, wherein the opening/closing device further includes a fixing plate fixing the opening/closing structures and the operative connector.

6. The door unit according to claim 5, wherein the fixing plate includes at least one guide protrusion to guide movement of the operative connector, and the operative connector includes at least one guide slot corresponding to the at least one guide protrusion.

7. The door unit according to claim 2, wherein the latch is provided between the pressure member and the operative connector.

8. The door unit according to claim 5, wherein the fixing plate includes hinge holes defined therein and providing for detachable insertion of the respective hinges.

9. The door unit according to claim 1, wherein the opening/closing device is provided at an upper end of the door.

10. The door unit according to claim 1, wherein the opening/closing device is provided at a lower end of the door.

11. A refrigerator including a body in which items are cooled and a door unit provided to open or close the body thereof, the refrigerator comprising:

hinges protruding from left and right sides of the body;

a fixing plate having hinge holes defined therein and receiving the respective hinges;

a pair of opening/closing structures provided at opposite sides of the fixing plate, each of the opening/closing structures receiving and holding one of the hinges in a first position of the fixing plate and at least one of the opening/closing structures being detachable from and releasing the respective hinge in a second position of the fixing plate; and an operative connector spaced apart from the pair of opening/closing structures by a predetermined distance in the first position of the fixing plate, one of the pair of opening/closing structures abutting against and pressing the operative connector in one direction when the fixing plate is moved from the first position to the second position such that movement of the other of the opening/closing structures is limited by movement of the operative connector.

12. The refrigerator according to claim 11, wherein the operative connector includes elastic elements, and wherein the operative connector is returned to an original position when a pressure force applied to the operative connector by one of the opening/closing structures is removed.

13. A refrigerator, comprising:

a body storing items to be cooled;

a door attached to the body to open or close the body;

a pair of hinges protruding from the body; and at least one opening/closing device disposed at a top or a bottom of the door and receiving the pair of hinges, the opening/closing device allowing, the door to be selectively opened in a leftward or rightward direction, the at least one opening/closing device including a pair of latches, a fixing plate, and an operative connector disposed between the pair of latches, each of the latches and the fixing plate receiving and holding one of the hinges, the latches being spaced apart from the operative connector in a first position of the at least one opening/closing device and one of the pair of latches abutting against and pressing the operative connector in one direction when the at least one opening/closing device is moved from the first position to a second position when the door is selectively opened in a leftward or rightward direction.

14. The refrigerator according to claim 13, wherein the door includes a pair of hinges and the opening/closing device includes a pair of hinge holes at opposing ends thereof, each one of the hinges being receivable into one of the hinge holes.

15. The refrigerator according to claim 14, wherein each of the latches includes a recess, each of the hinges are held within one of the hinge holes and the recess when the door is closed and one of the hinges is released from one of the hinge holes and the recess when the door is selectively opened in a leftward or rightward direction.

16. The refrigerator according to claim 15, wherein the at least one opening/closing device includes a pressure member to pressure each of the latches to keep each of the latches at a rotated position.

17. The refrigerator according to claim 13, wherein each of the latches includes an eccentric portion pressurizing the operative connector when the door is selectively opened in the leftward or the rightward direction.

18. The refrigerator according to claim 17, wherein the operative connector includes at least one elastic element causing the operative connector to elastically return when a pressure force applied to the operative connector by the eccentric portion is removed.

19. The refrigerator according to claim 13, wherein each of the latches includes an over-rotation preventing portion defined therein to prevent an over-rotation of each of the latches.

* * * * *

UNITED STATES PATENT AND TRADEMARK OFFICE

CERTIFICATE OF CORRECTION

PATENT NO. : 7,913,355 B2
APPLICATION NO. : 12/007473
DATED : March 29, 2011
INVENTOR(S) : Young Keun Choi It is certified that error appears in the above-identified patent and that said Letters Patent is hereby corrected as shown below:

Column 9, Line 34, In Claim 13, delete “allowing,” and insert -- allowing --, therefor.

Signed and Sealed this
Twenty-first Day of February, 2012

David J. Kappos

David J. Kappos
*Director of the United States Patent and Trademark Office*